US005878637A

United States Patent [19]

Liu

[11] Patent Number: 5,878,637

[45] Date of Patent: Mar. 9, 1999

[54] MAGNETIC DRIVING TOOL HAVING A TELESCOPIC PIPE

[76] Inventor: Kuo Zhen Liu, No. 31, 12th Road, Gong Yeh Chu, Da Li City, Taichung Hsien, Taiwan

[21] Appl. No.: 957,968

[22] Filed: Oct. 21, 1997

Related U.S. Application Data

[63] Continuation-in-part of Ser. No. 643,026, May 2, 1996, abandoned.

[51] Int. Cl.[6] ..... B25B 23/08

[52] U.S. Cl. ..... 81/451; 7/168; 294/65.5

[58] Field of Search ..... 7/138, 165; 81/125, 81/438, 451; 294/65.5

[56] References Cited

U.S. PATENT DOCUMENTS 4,448,097 5/1984 Rocca .

5,487,576 1/1996 DuVivier .

FOREIGN PATENT DOCUMENTS 718990 6/1952 United Kingdom .

*Primary Examiner*—James G. Smith

*Attorney, Agent, or Firm*—Charles E. Baxley, Esq.

[57] ABSTRACT

A driving tool includes a barrel and a handle secured to one end of the barrel for rotating the barrel. The barrel includes an engaging opening formed in the other end for engaging with a tool bit and a fastener. A telescopic pipe is engaged in the bore of the barrel and has one end secured to the handle and has a magnetic member secured to the other end for allowing the magnetic member to be extended outward of the barrel to attract and to fetch the fasteners engaged in a deep hole of an object.

1 Claim, 3 Drawing Sheets

MAGNETIC DRIVING TOOL HAVING A TELESCOPIC PIPE

The present invention is a continuation-in-part of U.S. patent application No. 08/643,026, filed on May 2, 1996.

BACKGROUND OF THE INVENTION

1. Field of the Invention

The present invention relates to a driving tool, and more particularly to a socket wrench having a telescopic pipe.

2. Description of the Prior Art

Typical driving tools, such as wrenches or screw drivers, comprise a driving stem having an engaging hole formed in one end for engaging with a tool bit or for engaging with a fastener and for driving the same. Two typical driving tools are disclosed in UK patent no. 718,990 to Ulfving, and in U.S. Pat. No. 4,448,097 to Rocca. The typical driving tools comprise a driving stem having either of two ends adapted to be engaged in an outer sleeve and adapted to be driven by the outer sleeve. The ends of the driving stem may be used for engaging with and for driving tool bits and/or fasteners. However, the driving tools may not be used for fetching the fasteners dropped in a deep hole such that an additional tool is required for fetching the fasteners. U.S. Pat. No. 5,487,576 discloses a tool having an extendible member. However, the tool also may not be used for fetching the fasteners dropped in a deep hole and may not be used as a driving tool.

The present invention has arisen to mitigate and/or obviate the afore-described disadvantages of the conventional magnetic socket wrenches.

SUMMARY OF THE INVENTION

The primary objective of the present invention is to provide a magnetic driving tool having a telescopic pipe for fetching the fasteners engaged in a deep hole.

In accordance with one aspect of the invention, there is provided a driving tool comprising a barrel including a bore and including a first end and including a second end having an engaging opening for engaging with a tool bit and a fastener, a handle secured to the first end of the barrel for rotating the barrel, a telescopic pipe engaged in the bore of the barrel and including a first end secured to the handle and including a second end adapted to be extended outward of the bore of the barrel, and a magnetic member secured to the second end of the telescopic pipe for allowing the magnetic member to be extended outward of the bore of the barrel. The barrel may be used for driving tool bits and/or fasteners and the telescopic pipe may be used for fetching the fasteners that are engaged in the deep hole of an object.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
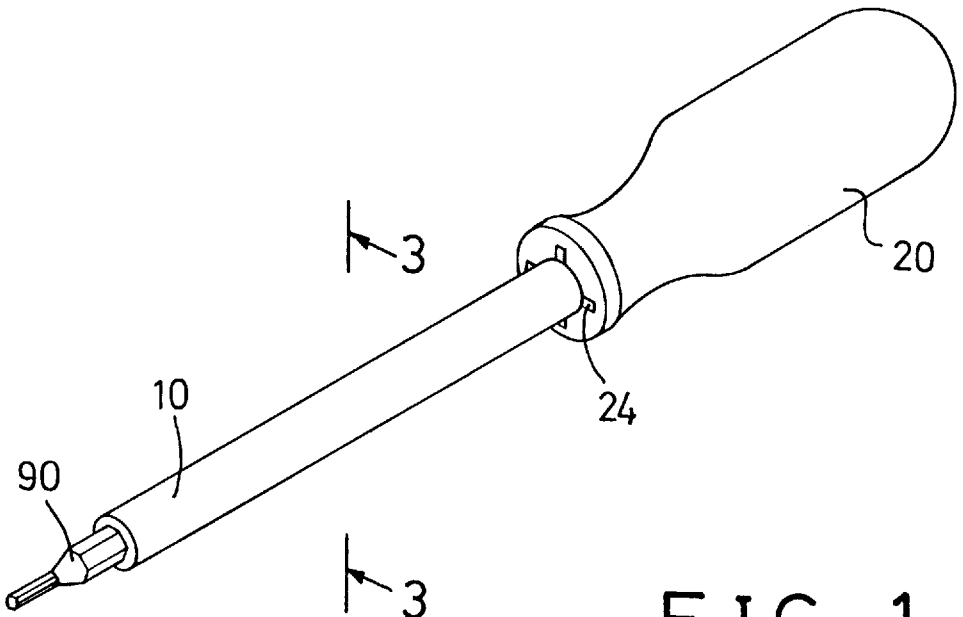
FIG. 1 is a perspective view of a driving tool in accordance with the present invention.
Figure 3:
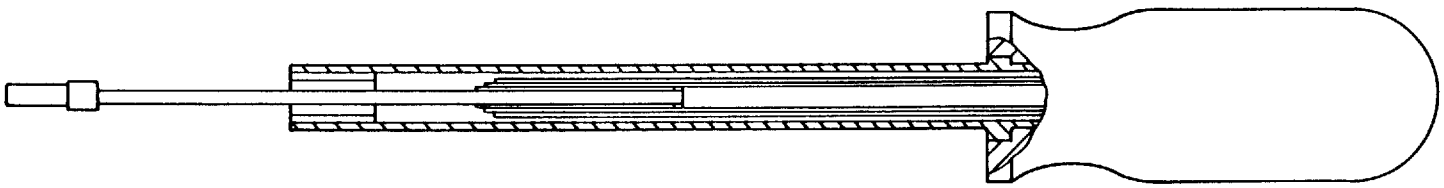
FIG. 3 is a partial cross sectional view taken along lines 3—3 of FIG. 1.
Figure 2:
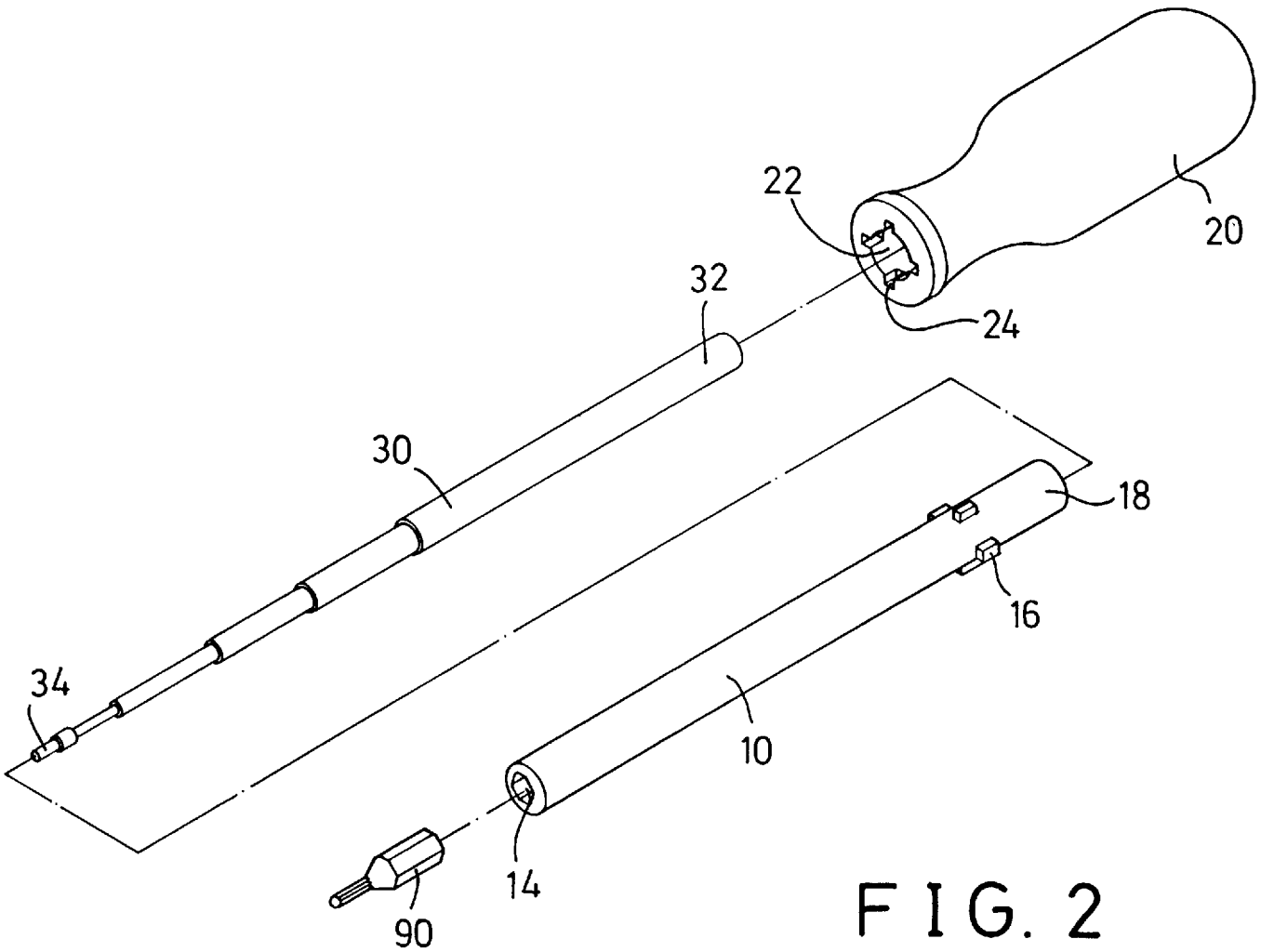
FIG. 2 is an exploded view of the driving tool.
Figure 4:
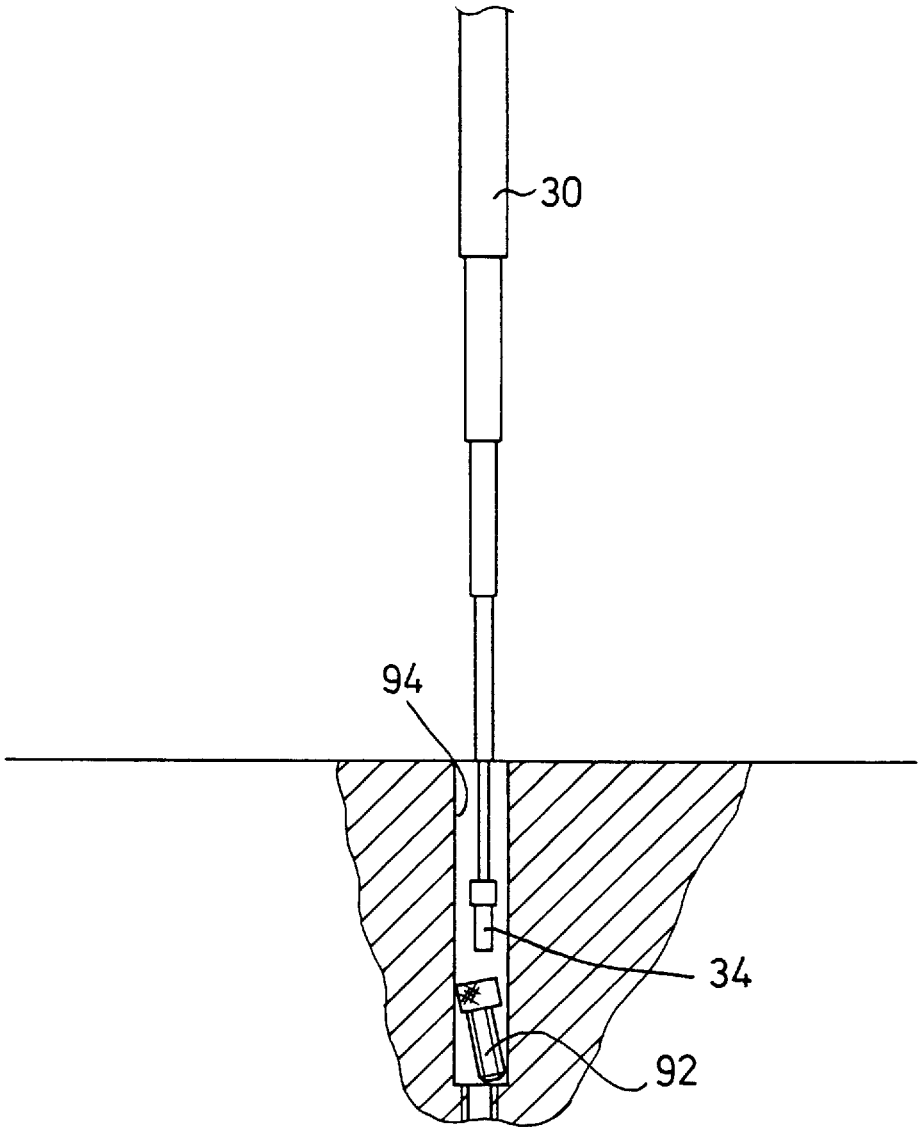
FIG. 4 is a schematic view illustrating the operation of the driving tool.

Referring to the drawings, and initially to FIGS. 1–3, a driving tool in accordance with the present invention comprises a barrel 10 including a bore 12 for slidably receiving a telescopic pipe 30 and including an engaging opening 14 formed in one end for engaging with and for driving a tool bit 90 or a fastener 92 (FIG. 4). The barrel 10 includes one or more keys 16 formed on the other end 18 for engaging with the grooves 24 of a handle 20 by such as a force-fitted engagement. The other end 18 of the barrel 10 is engaged in the hole 22 of the handle 20. Alternatively, the other end 18 of the barrel 10 may also be solidly secured in the hole 22 of the handle 20 by molding process, for example. The telescopic pipe 30 includes one end 32 secured in the handle 20 and includes a magnetic member 34 secured to the other end for allowing the magnetic member 34 to be extended outward of the barrel 10 and for allowing the magnetic member 34 to attract the fastener 92 that is engaged in a deep hole 94.

In operation, as shown in FIG. 4, the magnetic member 34 of the telescopic pipe 30 may be extended outward of the barrel 10 and may be engaged into the deep hole 94 of an object for easily attracting and fetching the fastener 92. When the telescopic pipe 30 is retracted into the bore 12 of the barrel 10, the engaging opening 14 of the barrel 10 may also be used for engaging with and for driving the tool bit 90 or the fastener 92 directly. The magnetic member 34 may be moved inward of the bore 12 of the barrel 10 by the tool bit 90 or the fastener 92, and may be moved and pulled outward of the barrel 10 by the tool bit 90 which may be engaged into the engaging opening 14 for allowing the tool bit 90 to be attracted by the magnetic member 34.

Typical driving tools may not be used for fetching the fasteners engaged in the deep hole and fail to disclose a driving tool having a telescopic pipe for allowing the magnetic member to be extended outward of the driving barrel. The driving tool in accordance with the present invention may be used for driving a tool bit or a fastener and may be used for easily fetching the fasteners engaged in a deep hole, such that the driving tool benefits the workers a lot.

Accordingly, the driving tool in accordance with the present invention includes a driving barrel for driving a tool bit or a fastener and includes a telescopic pipe for fetching the fasteners engaged in a deep hole.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A driving tool comprising:

a barrel including a bore and including a first end and including a second end having an engaging opening for engaging with a tool bit and a fastener, a handle secured to said first end of said barrel for rotating said barrel;

a telescopic pipe engaged in said bore of said barrel and including a first end secured to said handle and including a second end adapted to be extended outward of said bore of said barrel, and a magnetic member secured to said second end of said telescopic pipe for allowing said magnetic member to be extended outward of said bore of said barrel.

* * * * *